US005501014A

United States Patent [19]

Hegemann

[11] Patent Number: 5,501,014

[45] Date of Patent: Mar. 26, 1996

[54] SAFETY RAZOR CARTRIDGE WITH PASS-THROUGH APERTURES AND PROCESS OF MAKING

[76] Inventor: Kenneth J. Hegemann, 7301 E. Evans Rd., Scottsdale, Ariz. 85260

[21] Appl. No.: 293,552

[22] Filed: Aug. 22, 1994

[51] Int. Cl.[6] ..... B26B 21/18

[52] U.S. Cl. ..... 30/50; 30/346.5; 76/104.1

[58] Field of Search ..... 30/47–50, 346.5, 30/346.58, 346.59; 76/104.1

[56] References Cited

U.S. PATENT DOCUMENTS 5,331,740 7/1994 Carson et al. ..... 30/50

*Primary Examiner*—Douglas D. Watts

*Attorney, Agent, or Firm*—Robert G. Crouch; Chrisman, Bynum & Johnson

[57] ABSTRACT

A shaving cartridge including spaced-apart first and second razor blades each having an elongated edge formed thereon for cutting and shaving whiskers and hair, a container for retaining the blades therein and presenting the cutting edges at an angle for shaving action against the skin, the cartridge having formed therein a pass-through aperture between the blades allowing passage of shaved material away from the cutting edge to allow movement of the blade over the skin free of accumulations of cut material.

13 Claims, 2 Drawing Sheets

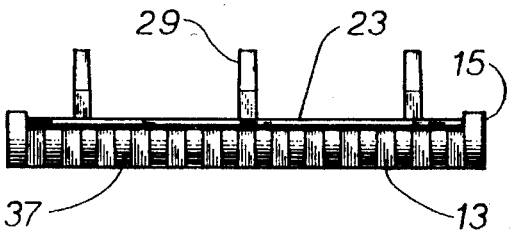
FIG. 3
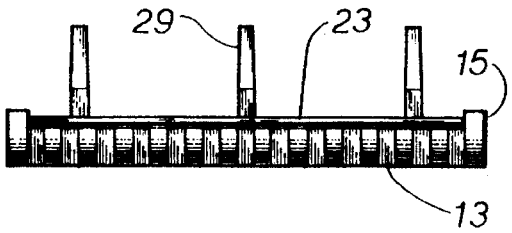
FIG. 3a
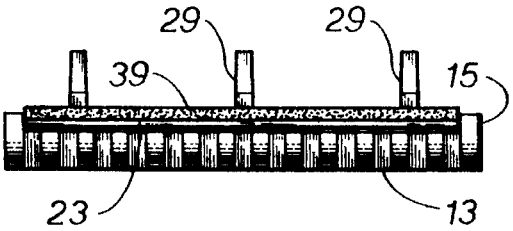
FIG. 4
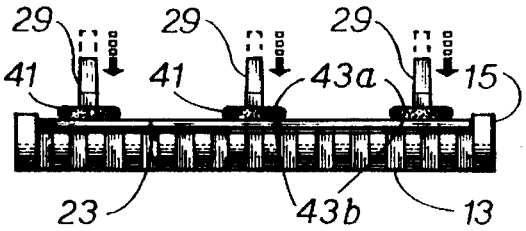
FIG. 4a
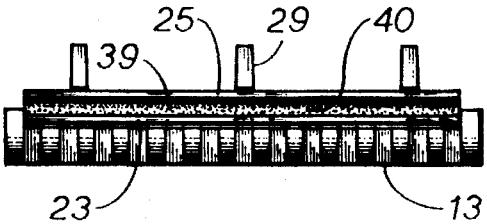
FIG. 5
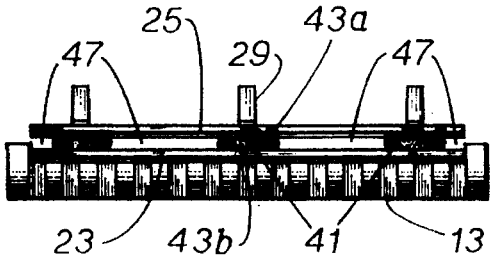
FIG. 5a
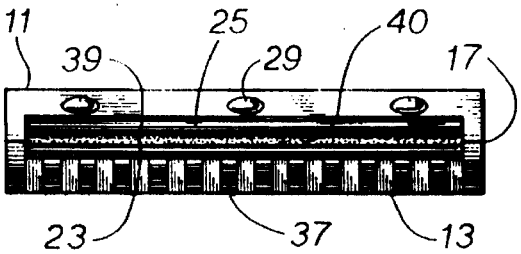
FIG. 6
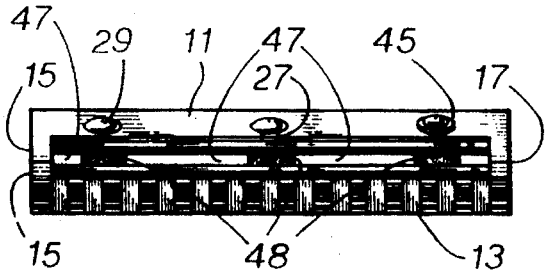
FIG. 6a
FIG. 7
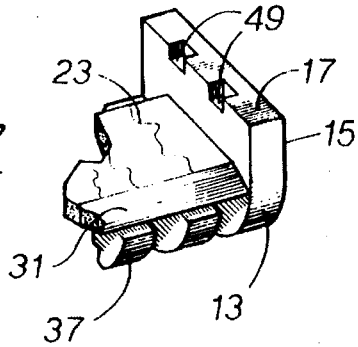
FIG. 8
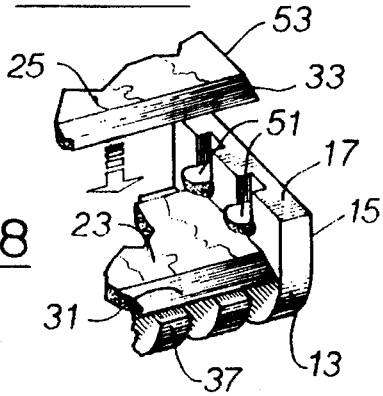

SAFETY RAZOR CARTRIDGE WITH PASS-THROUGH APERTURES AND PROCESS OF MAKING

BACKGROUND OF THE INVENTION

1. Field of the Invention

This invention concerns shaving cartridges. More specifically, it pertains to hand-held razor cartridges having at least one, but preferably a plurality of spaced-apart cutting edges for shaving and pass-through areas or apertures located between the cutting edges to accommodate removal of shaving cream and cut whiskers.

2. Description of the Prior Art

For centuries, men and women have used sharpened blades to shave whiskers and hair from their faces, legs and other areas of their body. The initial instruments were crude and caused much discomfort, irritation and laceration. Within the last 50 years, however, the art of shaving has been vastly improved. As personal hygiene has become of greater importance, the industry has looked to novel shaving systems that maximize close, long-lasting shaves, free of irritation and discomfort.

One of the improvements in the last few decades has been the multi-blade, disposable, safety razor. This device generally comprises a razor cartridge, for use with a handle. Two shaving blades are mounted in the cartridge in parallel, spaced-apart arrangement with their cutting edges slightly protruding from the front edge of the blade receptacle. As the user moves the cartridge and blades therein along the shaving plane, the cutting edges of the blades shave off the whiskers and hair.

However, conventional multi-blade razors collect debris between the blades and within a short period of time, an inventory or buildup of this debris, i.e., whiskers, shaving cream and water, accumulate sufficient to inhibit the designed smooth shaving action. To regain the desired shaving effect, the user must frequently rinse the razor blades of this inventory. This has proven to be a tedious task.

One of the leading causes of this problem lies in the way the razor blades are assembled. The blade cartridge is slightly longer and wider than the blades and the bottom or base provides a platform on which the blades are placed. In the assembly of the elements, the first razor blade is placed on the base of the cartridge with its cutting edge extending slightly forward or at an angle thereto for shaving action. A narrow spacer plate is next placed on the top surface of the blade, then another razor blade is laid on top of the spacer plate. The spacer plate is narrower than the blades so that its leading edge does not interfere with the cutting action of the razor blades. After the second blade is laid down, the top of the cartridge or cap is laid over the stack. A plurality of pegs or stubs, made integral with the cap, are directed downward into openings formed in the blades and the spacer plates and seated in apertures formed in the lower wall of the base. A rivet or other fastening device is incorporated with these stubs to render the whole stack locked tightly together. Unfortunately, to make this whole stack of elements a fixed combination of parts, it is necessary for the spacer plates to extend the full length of the blades. This creates concave areas between the razor blades and the spacer plate where soap, water and cut whiskers accumulate and eventually build up past the edges of the blades causing the blades to be held away from the skin. These cavities must be continually rinsed to allow the blades to resume their shaving ability. This rinsing procedure uses relatively large volumes of water and is thus wasteful of our natural resources. In addition, the rinsing step increases the overall time needed to shave, thus removing from the work force units of time which could be more efficiently employed elsewhere.

The present invention is a novel, multi-blade razor that is simple and efficient to produce and that contains wash-through apertures between the razor blades allowing the blades to remain free of soap and whiskers throughout the shaving process. The present invention creates these pass-through areas by placing spacers between the blades thereby creating an unobstructed open aperture extending from front to rear of the blade cartridge. Once the blades have cut the whiskers, the soap, water and other debris are displaced from the face of the cartridge near the cutting edges of the blades to the rear of the cartridge and pushed out therefrom by introduction of other soap, whiskers and debris introduced along the cutting edge of the razor blade. This allows the debris to be continuously removed from the razor blade without the need to rinse the area. In addition, the aforesaid inventory of debris may be flushed away by an incoming stream of water directed through the apertures.

SUMMARY OF THE INVENTION

The present invention overcomes the aforesaid difficulties in the prior art and provides the means of obtaining a close shave and, at the same time, provides the means to dispose of unwanted whiskers and foreign objects away from the cutting edges of the blades. Thus, the present invention provides a close, comfortable and clean shave without premature shaving interruptions due to clogged areas about the cutting edges of the razor blade. The invention lies not only in the cartridge but in its manufacture. The razor provides a quicker shave, uses less rinse water during the shaving process, while the method of manufacturing the cartridge utilizes less components and is rendered less time-consuming.

The shaving cartridge of this invention comprises, in its preferred embodiment form, first and second razor blades, each having elongated edges formed thereon for cutting and shaving whiskers and hair, cartridge means including a frontless and backless hollow container defined by spaced-apart elongated cap and base and spaced-apart shorter side walls joined together to form a rigid structure wherein the cap and base are joined together by a plurality of stubs passing therebetween on which upsets are formed to provide the requisite spacing between the blades and pass-through apertures along the surfaces of the blade to divert soap, water and whiskers form the cutting edges, and allow this accumulation to pass out of the cartridge. A standard handle is provided, attached to the cartridge, to manipulate the shaving cartridge over the skin.

The process of assembling the shaving cartridge utilizes a step wherein the stubs, passing through apertures formed in the razor blades, and into the cap and base, are upset and slightly shortened to expand their mass in a controlled manner into a short and wider doughnut-shaped spacer that holds the razor blades in separate arrangement and thereby forms the pass-through apertures in the cartridge. The result is a lighter razor with self-cleaning passages that allow movement of the inventory of soap, water and cut hair away from the cutting edges of the razor blades to present a continuously usable razor blade for shaving action.

In another embodiment, the short side walls of the cartridge are notched with a shoulder formed therein and the ends of the razor blades assembled with these shoulders to provide additional stabilization to the blades during the shaving process. In a further embodiment, a separate, washer-like spacer can be substituted for the upset to form the pass-through aperture.

Accordingly, the main object of this invention is a shaving cartridge having pass-through apertures formed therein for diverting the inventory of soap, water and cut hair or whiskers from the cutting edge of the razor blade so that the razor always presents an unobstructed shaving edge to the user. Another main object of the invention is a unique method of assembling this cartridge wherein a portion thereof, namely the aligned stubs, are subject to an internal upset operation whereby a short area of length of the stub is converted into an expanded washer-like element having opposed lands at least one of which is placed against a razor blade to space it from an elongated surface to form the pass-through aperture.

Other objects of the invention include a shaving cartridge that may be assembled using fewer steps, using less materials, and is amenable to automatic or robotic assembly, thereby freeing a work person to perform more complicated tasks; a shaving cartridge that provides continuous removal of cut hair and whiskers from the blades thereby making the shaving process faster and less time-consuming; a shaving cartridge that requires less rinsing and cleaning thus using less of our precious clean water and reducing the load on our nation's sewer system; a shaving cartridge that requires less manipulation about the water faucet for rinsing, thus reducing the chances that the blades will contact the water faucet and become damaged; and, a shaving cartridge having greater internal support at various locations along the length of the razor blades, thus insuring the requisite intra-blade stability throughout the shaving process.

These and other objects of the invention will become more apparent upon reading the following description of the preferred embodiments taken together with the drawings appended hereto. The protection sought by the inventor may be gleaned from a fair reading of the claims that conclude this specification.

DESCRIPTION OF THE DRAWINGS

FIGS. 2 through 6*a* are front elevation illustrative views of the method of assembly of this novel shaving cartridge compared to the conventional method of assembling present day cartridge;

FIG. 7 is an illustrative view of a notch formed in the side wall of the device for providing additional support to the razor blades carried therein; and, FIG. 8 is another illustrative view of the notch after a further stamping operation to create a support for the blade.

DESCRIPTION OF THE PREFERRED EMBODIMENT

Figure 1:
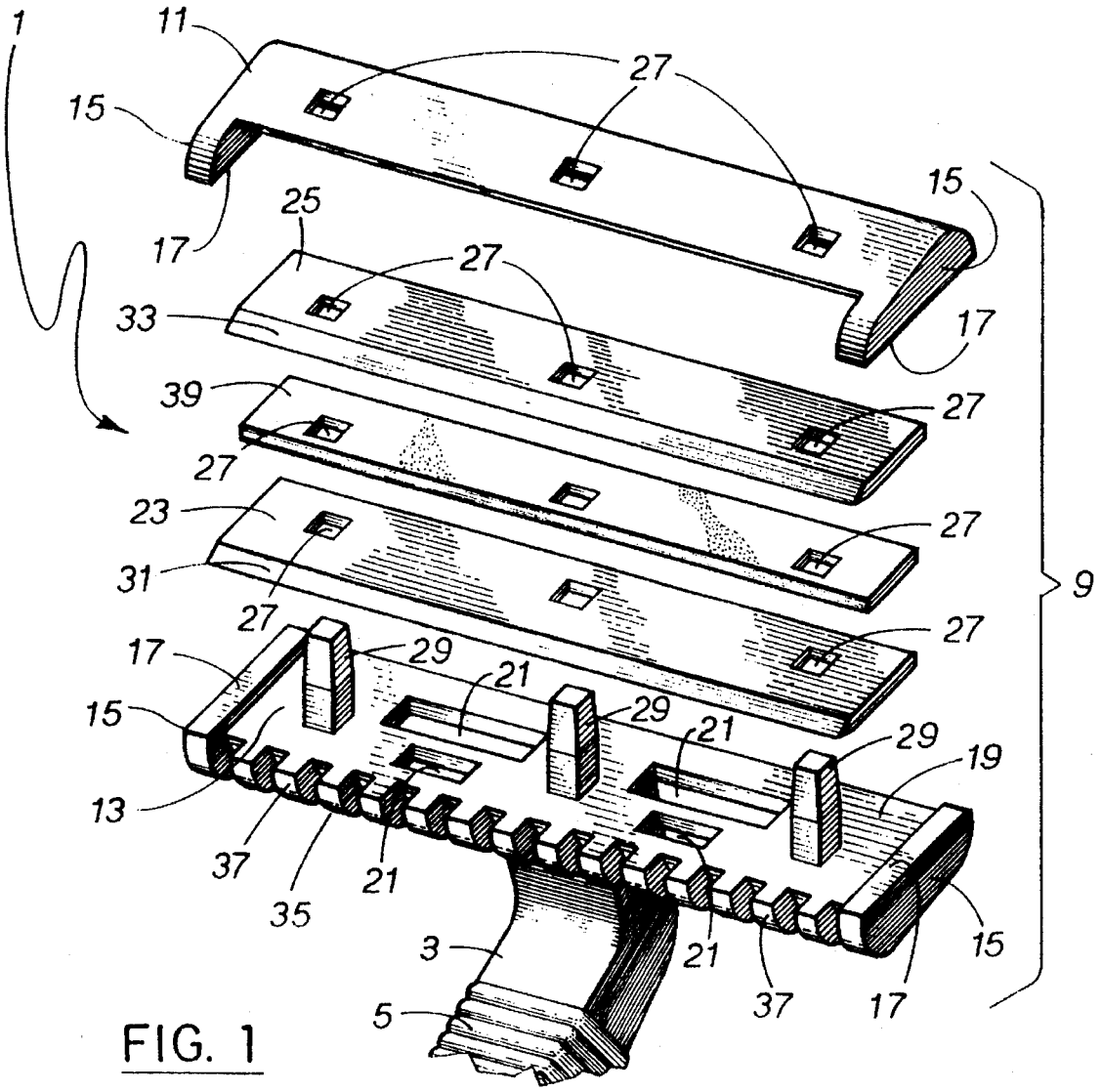
FIG. 1 is a disassembled view of a typical multi-blade shaving cartridge to which this invention is applicable.

Turning now to the drawings wherein like elements are identified with like numbers throughout the thirteen figures, FIG. 1 shows the elements of a typical two-blade shaving cartridge 1 that is used with a handle 3. Handle 3 forms no part of this invention. Cartridge 1 and handle 3 are usually made of plastic by such processes as injection molding and handle 3 may be made in a variety of sizes and shapes and contain surface irregularities such as ribs 5, for ease and accuracy in gripping with a soap-covered hand during the shaving process. The razor blades and the cartridge-grasping bracket (not shown) attached to said handle are conventionally made of metal.

Cartridge 1 may take a variety of configurations. However, for the purposes of this disclosure, it may be considered as comprising a frontless and backless hollow container 9 defined by spaced-apart top and bottom elements or a cap and a base 11 and 13 respectively. Cap 11 and base 13 are held in spaced-apart arrangement by a pair of spaced-apart, shorter side walls 15 wherein all said walls are joined together, either at their respective mating corners or along midpoint lines such as those shown at 17 in FIG. 1, to form a rigid structure. A working surface 19 is formed on the upper portion of base 13 and may be made of a monolithic piece of plastic or, more preferably, contain openings therein such as shown at 21 in FIG. 1, through which rinse water may pass to flush the surface thereof.

First, and preferable first and second, elongated, flat, razor blades 23 and 25 are provided for assembly between cap and base 11 and 13. As shown in FIG. 1, in the conventional form of a two-blade shaving cartridge, first blade 23 is set down against working surface 19 and aligned thereon by aligning a series of apertures 27, formed in said razor blades, with a plurality of upstanding posts, stubs or pegs 29, extending upward from working surface 19 and preferably made integral with base 13 through the injection molding process. Blades 23 and 25 have pre-sharpened cutting edges 31 and 33 respectively, formed along at least one elongated side edge. First blade cutting edge 31 is arranged to extend beyond the vertical front edge 35 of base 13 or at an angle to said base for shaving operation as is already known in the art. A series of protrusions 37 may be formed in front edge 35 to aid in passing the cartridge across one's skin, as is known in the art.

A first spacer plate 39 is conventionally set over stubs 29 through alignment apertures 27 and set atop first razor blade 23 and spanning the length of said cartridge. Thereafter, second razor blade 25 is laid atop spacer plate 39 and its apertures 27 aligned with stubs 29. Spacer plate 39 is narrower than razor blades 23 and 25 so that the front edge of said spacer plate 39 does not interfere with cutting edges 31 and 33, but is positioned inward therefrom toward the center of cartridge 1. Thereafter, top wall or cap 11 is lowered over the stacked razor blades 23 and 25 and spacer plate 39 such that stubs 29 extend upward beyond said cap through apertures 27. Thereafter, the top of said stubs are caused to seal over apertures 27 by thermal or cold deformation of the upper portions of stubs 29 so that cartridge 1 becomes a rigid, sealed, frontless and backless container having first and second razor blades 23 and 25 set in spaced-apart arrangement to provide two cutting edges for shaving action. It can be readily seen in this prior art assembly that the full length of spacer plate 39 forms an enclosed concavity 40 between blades 23 and 25 inboard of cutting edges 31 and 33 that will fill with soap, cut whiskers and hair to degrade the shaving ability of said cutting edges.

Figure 2:
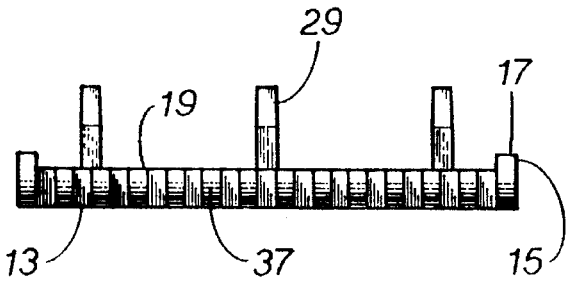
Figure 2A:
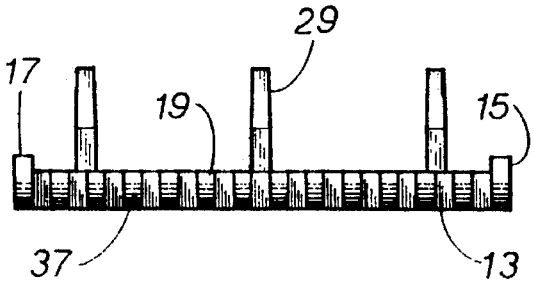

This assembly is shown in stages in FIGS. 2, 3, 4, 5, and 6. Shown in sequence in FIGS. 2*a*, 3*a*, 4*a*, 5*a*, and 6*a* are the steps of the novel method of assembling the novel shaving cartridge of this invention. Shown in FIG. 2 and 2*a* is the initial step of providing base 13 with a plurality of upstanding stubs 29 located between the ends of said wall. As shown in FIG. 3 and 3*a*, first razor blade 23 is set onto working surface 19 and aligned over stubs 29 through apertures 27 formed in said blade.

Thereafter, stubs 29, that are noticeably longer in FIGS. 2*a* and 3*a* than in conventional assembly as shown in FIGS.

2 and 3, are subject to an upset operation wherein the stubs are shortened by grasping them about their formed bodies, spaced above first razor blade 23, and pushing downward toward base 13 to force the plastic or other construction material to blossom outward, due to the malleable nature of the material, into a doughnut-shaped spacer 41 as shown in FIG. 4*a*. These doughnut-shaped spacers 41 comprise upper and lower, spaced-apart lands 43*a* and 43*b* respectively, wherein land 43*b* will abut the upper surface of first razor blade 23 and upper land 43*a* will abut the lower surface of second razor blade 25, as shown in FIG. 5*a*, during final assembly, to act to space them apart.

Following the creation of spacers 41, second razor blade 25 is assembled, as shown in FIG. 5*a*, over stubs 29 and aligned with first razor blade 23. Thereafter, cap 11 is fitted over stubs 29 so that said stubs extend upward through apertures 27. As shown in FIG. 6*a*, stubs 29 are subject to a sealing operation to render container 9 in a fixed and rigid form. This sealing operation can include the placement of a tight-fitting washer 45 over that portion of stub 29 extending above cap 11, as shown in FIG. 6*a*, and the exposed portion of stub 29 deformed thereover, such as by heat or cold forming, to form a rivet-like fitting. Another method of sealing is to fashion apertures 27 in cap 11 tightly fitting about stubs 29 so that the exposed portion of said stubs may be deformed, as aforesaid, over said apertures without the need for washer 45.

As can be clearly seen in FIGS. 5*a* and 6*a*, a plurality of pass-through apertures 47 is formed between the external surfaces of spacers 41 and the facing surfaces of razor blades 23 and 25. These apertures extend completely through container 9, from front to rear thereof, so that, as whiskers and hair are being shaved from the skin, said inventory will accumulate in said apertures and pass through container 9 to exit the other side of container 9 and not accumulate adjacent cutting edges 31 and 33. These apertures 47 may also be formed above and/or below either blade 23 and/or 25 or above one blade and below another or any combination thereof. Handle 3 is attached or attachable to base 13 or cap 11 depending upon the relative sizes thereof as already known in the prior art.

In addition to upset spacers 41, the step of forming said spacers can be replaced by the step of providing small, preformed washers 48 over stubs 29, as shown in FIG. 6*a*. These washers would be shaped the same as shown for spacers 41 and form pass-through apertures 47 as aforesaid. However, this is not the most preferred embodiment because it requires extra material and extra handling steps and is not as efficient as the preferred embodiment. In addition, the step of making the upset is more conveniently carried out by robotic operation to reduce assembly time and cost.

Conventionally, razor blades 23 and 25 extend all the way to the interior surface of side walls 15. It is contemplated that sufficient stubs 29 will be provided to support cutting edges 31 and 33 in precise, spaced-apart arrangement throughout the shaving process. However, tests have shown that significant stress is placed on the blades by the user during the shaving operation. In order to provide even more support to blades 23 and 25, another embodiment, shown in FIG. 7, may be provided wherein one or more notches 49 are molded or otherwise formed on the inside surface of side wall 15. Thereafter, said notch or notches are subject to a cold press operation that deforms notch 49 into a shoulder 51 as shown in FIG. 8 on which the end 53 of second razor blade 25 may be positioned to provide this additional support, as well as providing a space between lower blade 23 and upper razor blade 25.

While the invention has been described by reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve the same results are within the scope of this invention.

What is claimed is:

1. A shaving device comprising:

a) first and second razor blades in spaced-apart arrangement having elongated edges formed thereon for cutting and shaving whiskers and hair; and, b) cartridge means for retaining said blades therein and presenting said cutting edges at an angle for shaving action against the skin, wherein said cartridge means includes a frontless and backlass hollow container defined by spaced-apart, elongated cap and base and spaced-apart, shorter side walls, said cap, said base and said walls joined together to form a rigid structure wherein said cap and base are further supported by at least one stub passing therebetween containing a monolithic spacer which is affixed to and is an integrally-formed part of said stub to provide additional support thereto and to said razor blades and to form a pass-through aperture between said blades allowing passage of shaved material away from said cutting edges to allow movement of said blade over the skin free of accumulations of cut material.

2. The shaving cartridge of claim 1 wherein said cap and base are supported by three stubs, spaced equally apart, each containing one of said spacers to provide additional support thereto and to said razor blades.

3. The shaving cartridge of claim 1 wherein said spacer is formed from an upset on each of said stubs, said upset defined by spaced-apart, parallel and flat landings that are in contact with the inwardly-facing surfaces of said razor blades and wherein said upset forms the sides of said pass-through apertures.

4. The shaving cartridge of claim 2 wherein said spacers are formed from an upset on each said stubs, said upset defined by spaced-apart, parallel and flat landings that are in contact with the inwardly-facing surfaces of said razor blades and wherein said upsets form the sides of said pass-through apertures.

5. A shaving cartridge comprising:

a) first and second razor blades, each having an elongated edge formed therealong for cutting and shaving whiskers and hair; and, b) cartridge means for retaining said blades therein in spaced-apart arrangement and presenting said cutting edges for shaving action;

c) said cartridge means including a frontless and backless hollow container defined by spaced-apart, elongated cap and base and spaced-apart, shorter side walls joined together to form a rigid structure wherein said cap and base are further supported by a plurality of stubs passing therebetween;

d) said razor blades being retained in said container and fixed therein to provide a plurality of spaced-apart cutting edges for shaving action wherein said stubs have formed thereon at least one spacer of larger size to aid in retaining said razor blades in spaced-apart arrangement;

e) said cartridge forming pass-through apertures between said blades and defined by the surfaces of said blades and the surfaces of said spacers;

f) wherein said second blade is further supported its respective ends by interfitting with a shoulder formed in the inner surfaces of said side walls.

6. A method of making a shaving cartridge containing two elongated razor blades comprising the steps of:

a) providing a base having a length greater than the length of the razor blades and defining a working surface thereon;

b) forming a plurality of upwardly extending side walls at the terminal ends of said base and a plurality of upwardly directed stubs on said working surface spaced equally therebetween;

c) placing a first, thin, flat razor blade over said working surface, said blade having formed therein apertures for alignment on said stubs, the cutting edge of said razor blade being set at an angle to the front edge of said base for shaving purposes;

d) forming an upset in each said stub above said first razor blade of a size larger than the apertures formed in said first and second razor blades;

e) depositing said second, thin, flat razor blade on said stubs above said upsets and arranging the cutting edge thereof to lie in close proximity with the cutting edge of said first blade so that pass-through apertures are formed between said upsets and the facing surfaces of said blades;

f) providing a cap defining a substantially flat working surface of size and shape similar to said working surface of said base and assembling it atop said second razor to form a frontless and backless hollow container surrounding said razor blades and said pass-through apertures; and, g) assembling said container into a rigid form for attachment to a handle thereto for controlled manipulation of said cutting edges about the area to be shaved.

7. The method of claim 6 further including the step of forming a shoulder in said side walls, above said first razor blade, extending outward from said side wall for support of said second razor blade in its assembly therein.

8. The method of claim 7 wherein the step of forming a shoulder in said side walls comprises the step of molding at least one notch in said side wall and the following step of cold pressing said notch to deform some of the side wall to form a shoulder extending outward from said side wall into said container.

9. The method of claim 6 wherein said step of forming said upsets is replaced with a step of providing spacers in the form of washers separately assembled over said stubs to retain said razor blades in spaced-apart relationship and define said pass-through apertures.

10. A method of making a shaving cartridge containing two elongated razor blades, comprising the steps of:

providing a base with a plurality of outwardly-directed elongated stubs;

placing a first razor blade with a plurality of apertures defined therein onto the stubs with the stubs extending through the apertures;

deforming at least one of the stubs to form a spacer on the stub at a location on the stub distally-spaced from the base to be on the opposite side of the first razor blade from the base;

placing a second razor blade with a plurality of apertures defined therein onto the stubs with the stubs extending through the apertures; and placing a cap onto the stubs to form the assembled shaving cartridge.

11. A method as defined in claim 10, wherein the deforming step includes pressing the stub toward the base.

12. A method as defined in claim 10, wherein the deforming step includes forming a doughnut-shaped spacer having a diameter greater than the diameter of the apertures in the first razor blade to securely fasten the first razor blade to the base.

13. A method as defined in claim 10, wherein the cap includes a plurality of apertures defined therein, and wherein the placing the cap onto the stubs step includes placing the cap so that the stubs extend through the apertures, and wherein the stubs are further deformed to securely fasten the cap to the base.

* * * * *